US007465217B2

(12) United States Patent
Kinoshita et al.

(10) Patent No.: US 7,465,217 B2
(45) Date of Patent: Dec. 16, 2008

(54) CMP CONDITIONER, METHOD FOR ARRANGING HARD ABRASIVE GRAINS FOR USE IN CMP CONDITIONER, AND PROCESS FOR PRODUCING CMP CONDITIONER

(75) Inventors: Toshiya Kinoshita, Tokyo-To (JP); Eiji Hashino, Futtsu (JP); Setsuo Sato, Futtsu (JP); Ryuichi Araki, Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 11/385,297

(22) Filed: Mar. 20, 2006

(65) Prior Publication Data

US 2006/0160477 A1 Jul. 20, 2006

Related U.S. Application Data

(62) Division of application No. 10/451,644, filed as application No. PCT/JP01/11209 on Dec. 20, 2001, now abandoned.

(30) Foreign Application Priority Data

Dec. 21, 2000 (JP) ..... 2000-388994
Aug. 30, 2001 (JP) ..... 2001-262167

(51) Int. Cl.
*B24B 1/00* (2006.01)

(52) U.S. Cl. ..... 451/28; 451/56; 451/443; 451/548; 51/295; 51/297; 51/309

(58) Field of Classification Search ..... 451/443, 451/56, 28, 548; 51/295, 297, 309
See application file for complete search history.

(56) References Cited

U.S. PATENT DOCUMENTS 4,536,195 A 8/1985 Ishikawa ..... 51/293
6,093,280 A 7/2000 Kirchner et al. ..... 156/345
6,190,240 B1 2/2001 Kinoshita et al. ..... 451/56

(Continued)

FOREIGN PATENT DOCUMENTS

JP 60-076965 5/1985

(Continued)

OTHER PUBLICATIONS

Patent Abstracts of Japan, JP 10-193269, Jul. 28, 1998.

*Primary Examiner*—Eileen P. Morgan
(74) *Attorney, Agent, or Firm*—Kenyon & Kenyon LLP

(57) ABSTRACT

Disclosed are CMP conditioners which can suppress micro-scratching of the surface of a semiconductor substrate and can realize stable CMP conditioner properties. The CMP conditioner according to the first aspect of the present invention comprises a support member and a plurality of hard abrasive grains provided on a surface of the support member, wherein the plurality of hard abrasive grains are regularly arranged on the surface of the support member. The CMP conditioner according to the second aspect of the present invention comprises a support member and a plurality of hard abrasive grains provided on the surface of the support member, wherein the plurality of hard abrasive grains are arranged on the surface of the support member regularly and so as for the density of the hard abrasive grains to decrease from the inner side of the support member toward the outer side of the support member.

5 Claims, 7 Drawing Sheets

U.S. PATENT DOCUMENTS

| | | | | |
|---|---|---|---|---|
| 6,213,856 | B1 * | 4/2001 | Cho et al. | 451/443 |
| 6,368,198 | B1 | 4/2002 | Sung et al. | 451/443 |
| 6,371,838 | B1 | 4/2002 | Holzapfel | 451/72 |
| 6,439,986 | B1 | 8/2002 | Myoung et al. | 451/443 |
| 6,517,424 | B2 | 2/2003 | Wielonski et al. | 451/443 |
| 6,752,708 | B1 | 6/2004 | Kinoshita et al. | 451/443 |

FOREIGN PATENT DOCUMENTS

| | | |
|---|---|---|
| JP | 04-250978 | 9/1992 |
| JP | 11-077535 | 3/1999 |
| JP | 2000-052254 | 2/2000 |
| JP | 2000-106353 | 4/2000 |
| WO | WO 98/51448 | 11/1998 |

* cited by examiner

CMP CONDITIONER, METHOD FOR ARRANGING HARD ABRASIVE GRAINS FOR USE IN CMP CONDITIONER, AND PROCESS FOR PRODUCING CMP CONDITIONER

This application is a divisional application under 35 U.S.C. §120 and 35 U.S.C. §121 of prior application Ser. No. 10/451,644 filed Jun. 19, 2003 now abandoned which is a 35 U.S.C. §371 of PCT/JP01/11209 filed Dec. 20, 2001, wherein PCT/JP01/11209 was filed and published in the Japanese language. The entire disclosure of prior application Ser. No. 10/451,644 which is a 35 U.S.C. §371 of PCT/JP01/11209 is considered part of this divisional application and is incorporated herein by reference.

BACKGROUND OF THE INVENTION

1. Field of the Invention

The present invention relates to a CMP conditioner for repairing loading of an polishing pad for a semiconductor substrate and for removing materials which have caused loading of the polishing pad, a method for arranging hard abrasive grains for use in a CMP conditioner, and a process for producing a CMP conditioner. The CMP conditioner is also called "CMP dresser" in the art.

2. Background Art

A polishing method called "CMP (chemical mechanical polishing)" has been proposed for polishing wafers. In CMP, chemical polishing action is superimposed on mechanical polishing action to realize a combination of ensuring of satisfactory removal rate with a defect-free polished object, and CMP has widely been used in the step of finish polishing a silicon wafer.

Further, in recent years, an increase in integration density of devices has led to the necessity of polishing the surface of a wafer or the surface of a semiconductor substrate, comprising an electric conductor/dielectric layer formed on a surface of a wafer, in a predetermined stage for the production of an integrated circuit. The semiconductor substrate is polished to remove surface defects such as high projections, scratches, and roughness. In general, this step is carried out during the formation of various elements and integrated circuits on a wafer. In this polishing step, as with the step of finish polishing a silicon wafer, a combination of a removal rate requirement with a defect-free requirement should be met. The introduction of chemical slurry can realize chemical and mechanical flattening of the surface of a semiconductor with higher polishing/removing speed and a defect-free state.

An example of the CMP step (process) is shown in FIG. 8. In this example, a chemical slurry 101 prepared by suspending, for example, silica particles having a diameter of about 5 to 300 nm in a solution of an alkali, such as caustic soda, ammonia, or amine, to prepare a slurry having a pH value of about 9 to 12 and an polishing pad 102 formed of a polyurethane resin or the like are used. At the time of polishing, a semiconductor substrate 103 is abutted against the polishing pad 102 by applying a suitable pressure while allowing the chemical slurry 101 to flow and spread on the polishing pad 102, and the semiconductor substrate 103 and the polishing pad 102 are rotated relatively to each other as indicated by arrows in the drawing.

The polishing pad 102 is conditioned (dressed) with a CMP conditioner while allowing water or the chemical slurry 101 to flow on the polishing pad 102 to repair loading of the polishing pad 102 and to remove materials which have caused the loading of the polishing pad 102. The conditioning with a CMP conditioner is carried out, either after the completion of polishing of the semiconductor substrate 103, by abutting the CMP conditioner against the polishing pad 102, or, simultaneously with the start of polishing of the semiconductor substrate 103, by abutting the CMP conditioner against the polishing pad 102 at its position different from the position where the semiconductor substrate 103 is abutted against the polishing pad 102.

In the CMP conditioner used in the conventional conditioning (brushing) of the polishing pad, as shown in FIG. 9, diamond grains 202 as hard abrasive grains are evenly distributed, for example, by manually spreading the diamond grains 202 over the surface of a disk-shaped support member 201 and then fixing the diamond grains 202 onto the support member 201.

In this case, however, whatever the diamond grains 202 are spread carefully, the distribution of the diamond grains 202 is disadvantageously such that the diamond grains 202 are sparsely present in some portion and are densely present in another portion. When this conditioner with uneven distribution of the diamond grains 202 is used, abrasive grains contained in the chemical slurry are disadvantageously likely to aggregate in a portion where the diamond grains 202 are densely present. This poses a severe problem that the aggregate of the abrasive grains is adhered to the polishing pad (102 in FIG. 8), and, consequently, microscratches the semiconductor substrate (103 in FIG. 8). Further, uneven distribution of the diamond grains 202 is causative of a difference between conditioners and hinders the development of stable conditioner properties.

Further, in the conventional CMP conditioner, since the slurry cannot be smoothly escaped, significant microscratching occurs. In order to improve the escape of the slurry, as shown in FIG. 14, for example, escape grooves 203 for escaping the chemical slurry 101 are provided in the support member 201. In this case, at the time of polishing, the chemical slurry 101 is escaped through the escape grooves 203. The formation of the escape grooves 203 in the support member 201, however, has a fear of adversely affecting CMP conditioner properties. Further, the formation of the escape grooves requires labor and a lot of time. This incurs increased cost.

SUMMARY OF THE INVENTION

In view of the above, the present invention has been made, and, in the first aspect of the present invention, an object is to suppress microscratching on the surface of a semiconductor substrate and, at the same time, to provide stable CMP conditioner properties.

According to the first aspect of the present invention, there is provided a CMP conditioner comprising: a support member; and a plurality of hard abrasive grains provided on a surface of the support member, characterized in that said plurality of hard abrasive grains are regularly arranged on the surface of the support member.

Another characteristic feature of the CMP conditioner according to the first aspect of the present invention is that said hard abrasive grains are arranged at respective lattice points of a unit lattice formed of a square on the surface of the support member.

A further characteristic feature of the CMP conditioner according to the first aspect of the present invention is that said hard abrasive grains are arranged at respective lattice points of a unit lattice formed of a regular triangle on the surface of the support member.

Another CMP conditioner according to the first aspect of the present invention comprises: a support member; and a plurality of hard abrasive grains provided on a surface of the support member, characterized in that the variation in density of the hard abrasive grains among regions having a given area where said hard abrasive grains are present is within ±50%.

Another characteristic feature of the CMP conditioner according to the first aspect of the present invention is that said hard abrasive grains are diamond grains.

A further characteristic feature of the CMP conditioner according to the first aspect of the present invention is that said diamond grains have been brazed in a single layer to said support member, formed of a metal and/or an alloy, with an alloy containing 0.5 to 20% by weight of at least one member selected from the group consisting of titanium, chromium, and zirconium and having a melting point of 650° C. to 1,200° C. to form a layer of a carbide of a metal selected from the group consisting of titanium, chromium, and zirconium at the interface between the diamond grains and the alloy.

A method for arranging hard abrasive grains for use in the CMP conditioner according to the first aspect of the present invention is characterized by comprising the steps of: positioning an arranging member in a thin plate form, provided with a plurality of regularly arranged through-holes, on an abrasive grain arrangement surface; and placing a hard abrasive grain in each through-hole of the arranging member.

Another characteristic feature of the method for arranging hard abrasive grains for use in the CMP conditioner according to the first aspect of the present invention is that the abrasive grain arrangement surface is a surface of a support member for constituting the CMP conditioner.

Another method for arranging hard abrasive grains for use in the another CMP conditioner according to the first aspect of the present invention is characterized by comprising the steps of: holding a plurality of hard abrasive grains, in a regularly arranged state, on a holding member; and transferring the hard abrasive grains held on the holding member onto the surface of a support member for constituting the CMP conditioner.

Another characteristic feature of the method for arranging hard abrasive grains for use in the another CMP conditioner according to the first aspect of the present invention is that said holding member has first bonding means for holding the hard abrasive grains and said support member has on its surface second bonding means which is different from said first bonding means in properties.

A process for producing the CMP conditioner according to the first aspect of the present invention is characterized by comprising the steps of: utilizing the method for arranging hard abrasive grains for use in the above CMP conditioner to arrange the hard abrasive grains on the surface of the support member; and then fixing the hard abrasive grains on the surface of the support member.

According to the first aspect of the present invention as described above, the problem of uneven distribution of hard abrasive grains can be solved. Therefore, the CMP conditioner does not lead to a fear that abrasive grains contained in the slurry aggregate in the dresser in its portion where hard abrasive grains are densely present.

In the second aspect of the present invention, an object is to provide stable CMP conditioner properties and, at the same time, to enable the escape of the slurry or the like at the time of polishing without forming escape grooves or the like, and to reduce microscratching.

According to the second aspect of the present invention, there is provided a CMP conditioner comprising: a support member; and a plurality of hard abrasive grains provided on the surface of the support member, characterized in that said plurality of hard abrasive grains are arranged on the surface of the support member regularly and so as for the density of the hard abrasive grains to decrease from the inner side of the support member toward the outer side of the support member.

Another CMP conditioner according to the second aspect of the present invention comprises: a support member; and a plurality of hard abrasive grains provided on a surface of said support member, characterized in that regions, where said plurality of hard abrasive grains are absent, are provided substantially radially on the surface of the support member.

A method for arranging hard abrasive grains for use in the CMP conditioner according to the second aspect of the present invention is characterized by comprising the steps of: positioning an arranging member in a thin plate form, provided with a plurality of through-holes arranged regularly and so as for the density of the through-holes to decrease from the inner side toward the outer side of the arranging member, on an abrasive grain arrangement surface; and placing a hard abrasive grain in each through-hole of the arranging member.

Another method for arranging hard abrasive grains for use in the CMP conditioner according to the second aspect of the present invention is characterized by comprising the steps of: positioning an arranging member in a thin plate form, in which regions free from a plurality of through-holes are provided substantially radially, on an abrasive grain arrangement surface; and placing a hard abrasive grain in each through-hole of the arranging member.

Still another method for arranging hard abrasive grains for use in the CMP conditioner according to the second aspect of the present invention is characterized by comprising the steps of: holding a plurality of hard abrasive grains, on a holding member, in such a state that the hard abrasive grains are arranged regularly and so as for the density of said hard abrasive grains to decrease from the inner side toward the outer side of the holding member; and transferring the hard abrasive grains held on the holding member onto the surface of a support member for constituting the CMP conditioner.

A further method for arranging hard abrasive grains for use in the CMP conditioner according to the second aspect of the present invention is characterized by comprising the steps of: holding a plurality of hard abrasive grains, on a holding member, in such a state that regions free from said plurality of hard abrasive grains are provided substantially radially; and transferring the hard abrasive grains held on the holding member onto the surface of a support member for constituting the CMP conditioner.

A process for producing the CMP conditioner according to the second aspect of the present invention is characterized by comprising the steps of: utilizing the method for arranging hard abrasive grains for use in the above CMP conditioner to arrange the hard abrasive grains on the surface of the support member; and then fixing the hard abrasive grains on the surface of the support member.

BRIEF DESCRIPTION OF THE DRAWINGS

FIGS. 6A and 6B are diagrams illustrating a second method for arranging diamond grains 2 in the first aspect of the present invention, wherein FIG. 6A shows spreading of diamond grains 2 over the arranging plate 7 and FIG. 6B shows such a state that a pressure-sensitive adhesive sheet 10 has been separated from the arranging plate 7;

DETAILED DESCRIPTION OF THE INVENTION

CMP Conditioner According to First Aspect of the Invention

Embodiments of the CMP conditioner for an polishing pad for a semiconductor substrate, the method for arranging hard abrasive grains for use in a CMP conditioner for an polishing pad for a semiconductor substrate, and the process for producing a CMP conditioner according to the first aspect of the present invention will be described with reference to the accompanying drawings.

Figure 1:
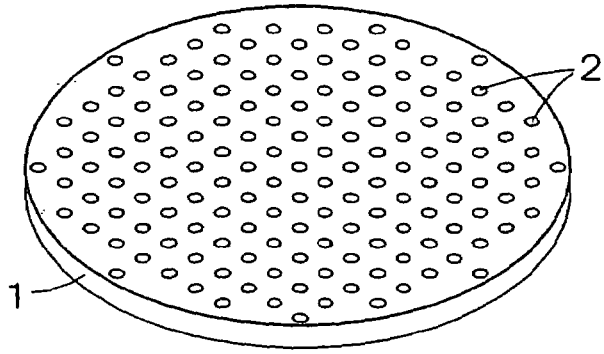
FIG. 1 is an explanatory view of a CMP conditioner according to the first aspect of the present invention.

The CMP conditioner will be first described in conjunction with FIG. 1. As shown in FIG. 1, diamond grains 2 as hard abrasive grains are fixed onto a surface of a disk-shaped support member 1 formed of a stainless steel or the like. The appearance of the CMP conditioner shown in FIG. 1 is a mere example. Diamond grains 2 may not be always present over the whole surface of the support member 1. Escape grooves for escaping a chemical slurry may be formed, for example, on the surface of the support member 1.

Figure 2:
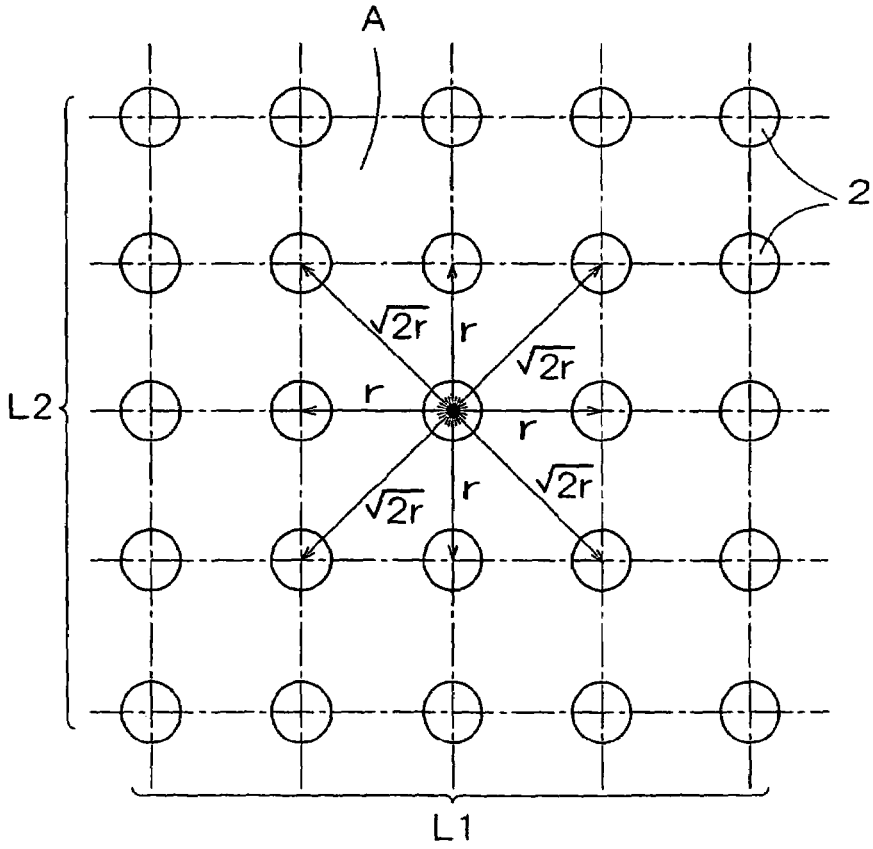
FIG. 2 is a diagram showing one embodiment of the arrangement of diamond grains 2 according to the first aspect of the present invention.
Figure 3:
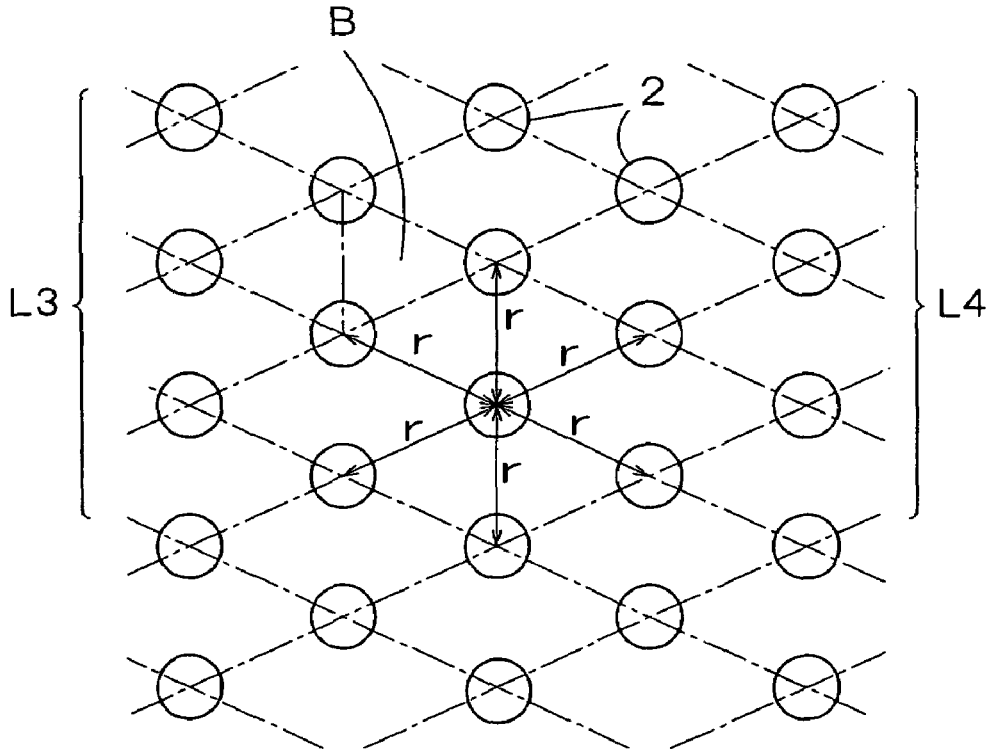
FIG. 3 is a diagram showing one embodiment of the arrangement of diamond grains 2 according to the first aspect of the present invention.

FIGS. 2 and 3 are enlarged views of the surface of the support member 1, illustrating the arrangement of diamond grains 2. In FIG. 2, diamond grains 2 are arranged in a check pattern. A diamond grain 2 is placed on each lattice point of a square unit lattice A on the surface of the support member 1. More specifically, it is assumed that, as indicated by alternate long and short dash lines in FIG. 2, a first group of straight lines $L_1$, which are arranged parallel to one another at given intervals, and a second group of straight lines $L_2$ (horizontal lines in FIG. 2), which are arranged parallel to one another at given intervals and intersect the first group of straight lines $L_1$ at 90 degrees, are provided. Diamond grains 2 are placed on points of intersection of the first group of straight lines $L_1$ and the second group of straight lines $L_2$.

In FIG. 3, diamond grains 2 are arranged in a honeycomb form. On the surface of the support member 1, a diamond grain 2 is placed on each lattice point of a unit lattice B of an equilateral triangle. More specifically, it is assumed that, as indicated by alternate long and short dash lines in FIG. 3, a third group of straight lines $L_3$, which are arranged parallel to one another at given intervals, and a fourth group of straight lines $L_4$, which are arranged parallel to one another at given intervals and intersect the third group of straight lines $L_3$ at 120 degrees, are provided. Diamond grains 2 are placed on points of intersection of the third group of straight lines $L_3$ and the fourth group of straight lines $L_4$.

In the arrangement shown in FIG. 2, the distance from a certain diamond grain 2 to each of four diamond grains 2 adjacent vertically and horizontally to the certain diamond grain 2 is r, and the distance of the certain diamond grain 2 to each of four diamond grains adjacent diagonally to the certain diamond grain is $(\sqrt{2})$ r.

On the other hand, in the arrangement shown in FIG. 3, all of six adjacent diamond grains 2 are equidistant from a certain diamond grain 2, that is, the distance of a certain diamond grain 2 to each of the six adjacent diamond grains 2 is r. Therefore, in the strict sense of the word, the distribution of diamond grains 2 in the arrangement shown in FIG. 3 is more homogeneous than the distribution of diamond grains 2 in the arrangement shown in FIG. 2. Therefore, the arrangement shown in FIG. 3 can provide superior CMP conditioner properties.

The method for arranging diamond grains 2 according to the second aspect of the present invention will be described with reference to FIGS. 4 to 7. In embodiments shown in FIGS. 4 to 7, diamond grains 2 are arranged by the following two methods.

Figure 4:
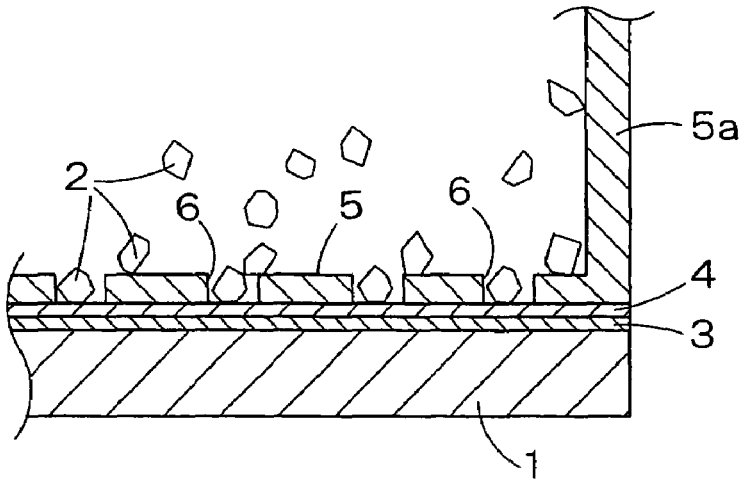
FIG. 4 is a diagram illustrating a first method for arranging diamond grains 2 in the first aspect of the present invention.

In the first method, as shown in FIG. 4, an adhesive 4 is previously coated onto a surface of a support member 1 provided with a brazing material 3. An arranging plate 5 is mounted on the support member 1 in its surface coated with the adhesive 4 to perform masking.

Figure 5:
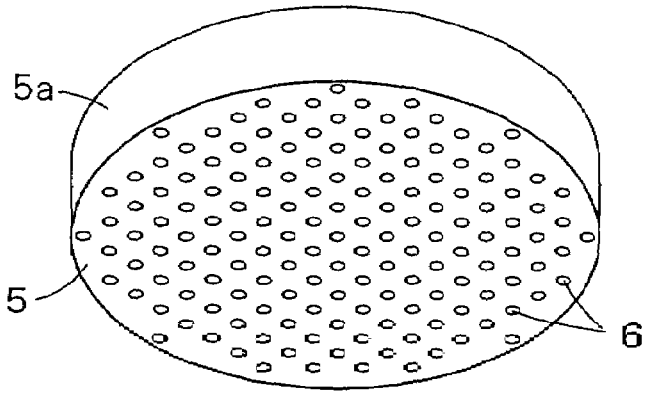
FIG. 5 is a diagram illustrating an arranging plate 5 according to the first aspect of the present invention.

As shown in FIG. 5, through-holes 6 for arranging diamond grains 2 are provided in the arranging plate 5. Specifically, in the arranging plate 5, through-holes 6 are arranged in a form identical to the arrangement shown in FIG. 2 or 3. The relationship between the diameter X of the through-holes 6 and the size D of the diamond grains 2 satisfies a requirement represented by formula $1.0D<X<2.0D$. Satisfying this relationship can prevent a plurality of diamond grains 2 from simultaneously entering one through-hole 6. A scattering preventive wall 5*a* is provided on the circumference of the arranging plate 5.

As shown in FIG. 4, in such a state that the arranging plate 5 is mounted on the surface of the support member 1, diamond grains 2 are spread over the arranging plate 5. At that time, for example, suitable vibration is applied to the arranging plate 5 so that the diamond grains 2 enter all the through-holes 6. When the diamond grains 2 have entered all the through-holes 6, excess diamond grains 2 present on the arranging plate 5 are removed, for example, by a brush. Thereafter, the arranging plate 5 is removed from the surface of the support member 1 to leave the diamond grains 2 arranged on the surface of the support member 1 as shown in FIG. 2 or 3.

After the diamond grains 2 have been arranged on the surface of the support member 1 by the above method, brazing in a single layer is carried out to fix the diamond grains 2. In this brazing, the adhesive 4 coated onto the surface of the support member 1 is sublimated upon heating of the brazing material 3 and thus does not stay on the surface of the support member 1.

In the first method, a mesh woven out of wire may be used instead of the arranging plate 5. Specifically, individual openings of the mesh are used as the through-holes 6 referred to in the arranging plate 5, and diamond grains 2 are put into the openings to arrange the diamond grains on the surface of the support member 1.

In the second method, unlike the first method wherein the diamond grains 2 are arranged directly on the surface of the support member 1, diamond grains are once arranged on a holding member, such as a pressure-sensitive adhesive sheet, and the arranged diamond grains are then transferred onto the surface of the support member 1.

Figure 6A:
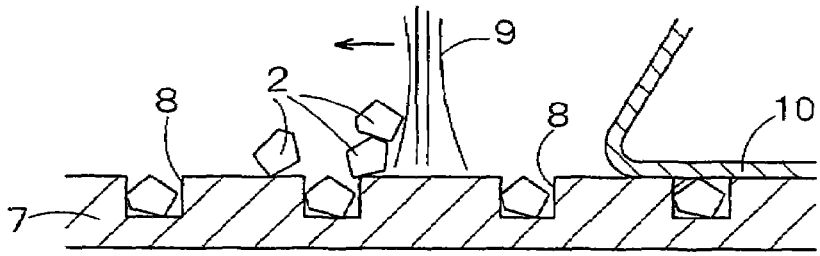

In the second method, as shown in FIG. 6A, concaves 8 for arranging diamond grains 2 are provided in an arranging plate 7 so as to conform to the arrangement shown in FIG. 2 or 3. In the concaves 8 in the second method, as with the through-holes 6 in the first method, the relationship between the diameter X of concaves 8 and the size D of the diamond grains 2 satisfies a requirement represented by formula $1.0D < X < 2.0D$.

Diamond grains 2 are spread over the arranging plate 7. At that time, as described above in connection with the first method, for example, suitable vibration is applied to the arranging plate 7 so that the diamond grains 2 enter all the concaves 8. When the diamond grains 2 have entered all the concaves 8, excess diamond grains 2 present on the arranging plate 7 are removed, for example, by a brush 9.

Figure 6B:
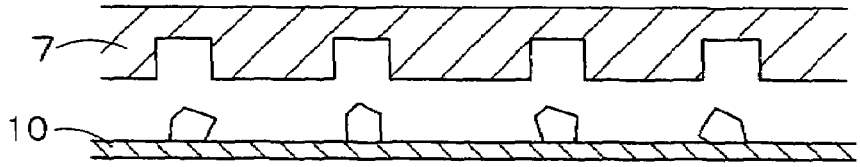

A pressure-sensitive adhesive sheet 10 is then applied onto the surface of the arranging plate 7 on its concave 8 side. Next, as shown in FIG. 6B, the pressure-sensitive adhesive sheet 10 is separated, for example, by turning the arranging plate 7 upside down, whereby the diamond grains 2 are arranged and held on the pressure-sensitive adhesive sheet 10.

Figure 7:
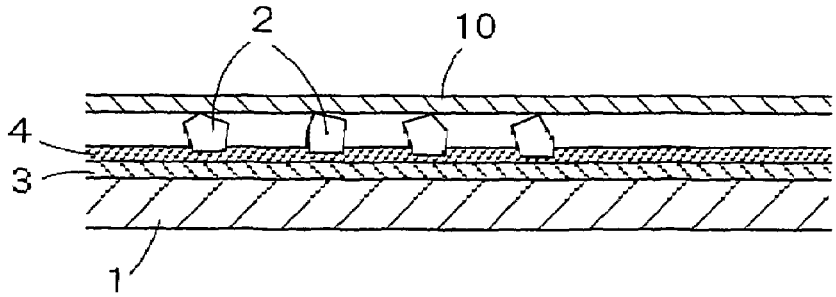
FIG. 7 is a diagram illustrating the second method for arranging diamond grains 2 in the first aspect of the present invention.
Figure 8:
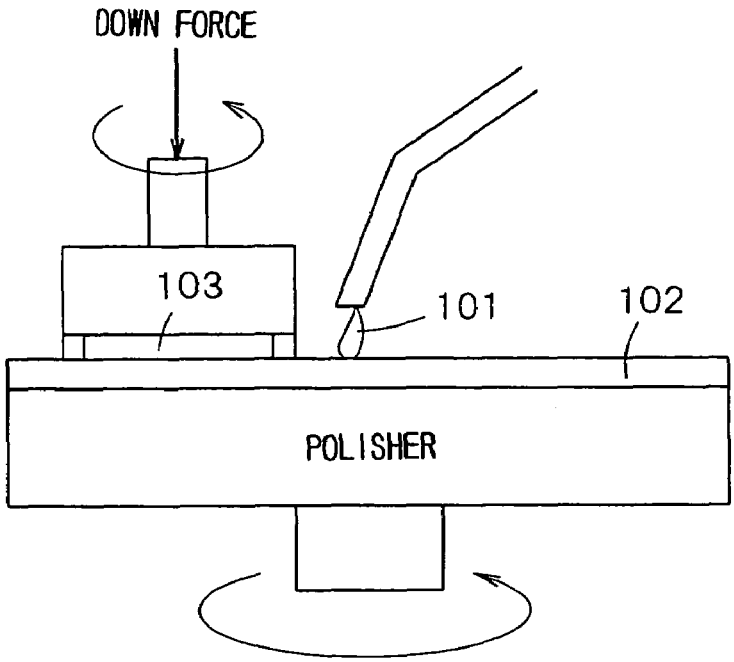
FIG. 8 is a diagram illustrating a CMP step.
Figure 9:
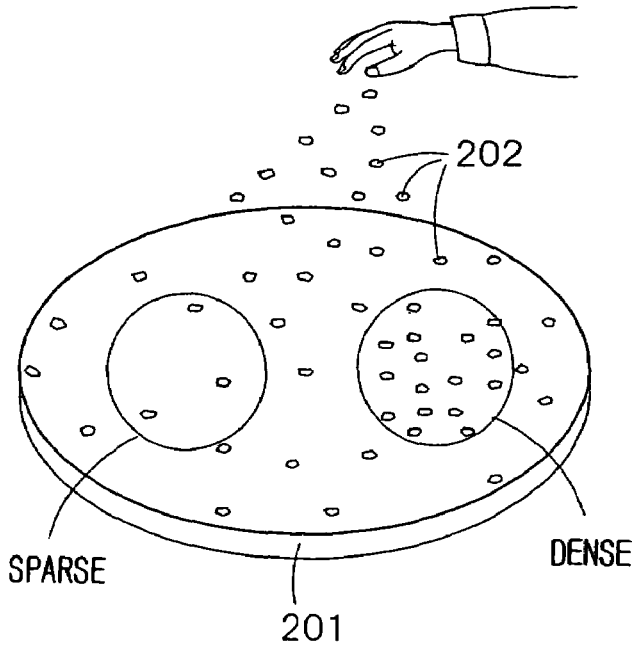
FIG. 9 is a diagram illustrating a conventional CMP conditioner.

Thereafter, the pressure-sensitive adhesive sheet 10 with the diamond grains 2 held thereon is applied onto the surface of the support member 1 coated with an adhesive 4 so that the diamond-holding pressure-sensitive adhesive surface of the pressure-sensitive adhesive sheet 10 comes into contact with the adhesive 4. Therefore, as shown in FIG. 7, one end of each diamond grain 2 is supported on the pressure-sensitive adhesive sheet 10 side, and the other end of each diamond grain 2 is supported on the surface side of the support member 1. Thereafter, only the pressure-sensitive adhesive sheet 10 is removed while allowing the diamond grains 2 to stay on the surface side of the support member 1. Thus, the diamond grains 2 can be arranged on the surface of the support member 1.

The removal of only the pressure-sensitive adhesive sheet 10 can be achieved, for example, by providing a difference in solubility between the adhesive in the pressure-sensitive adhesive sheet 10 and the adhesive 4 on the support member 1 side. In this case, in the state shown in FIG. 7, when the assembly is placed in an environment where the adhesive in the pressure-sensitive adhesive sheet 10 is dissolved, while maintaining the holding power of the adhesive 4 on the support member 1 side, only the adhesive in the pressure-sensitive adhesive sheet 10 can be dissolved to remove only the pressure-sensitive adhesive sheet 10.

After the diamond grains 2 have been arranged on the surface of the support member 1 by the above method, brazing in a single layer is carried out to fix the diamond grains 2. In this brazing, the adhesive 4 coated onto the surface of the support member 1 is sublimated upon heating of the brazing material 3 and thus does not stay on the surface of the support member 1.

In the second method, concaves 8 are provided in the arranging plate 7. Alternatively, through-holes may be provided instead of the concaves 8. In this case, when the support member 1 shown in FIG. 4 is changed to a pressure-sensitive adhesive sheet 10, diamond grains can be arranged on the pressure-sensitive adhesive sheet 10. Therefore, the diamond grains arranged on the surface of the pressure-sensitive adhesive sheet 10 can be then transferred onto the surface of the support member 1.

According to the above embodiments of the present invention, since the diamond grains are regularly arranged, the distribution of the diamond grains is even. The use of the CMP conditioners according to the above embodiments does not cause such an unfavorable phenomenon that abrasive grains contained in a slurry aggregate in a portion where diamond grains are densely present. Therefore, microscratching of the surface of the semiconductor substrate can be minimized. Further, since the difference in properties among CMP conditioners can be eliminated, stable CMP conditioner properties can be provided.

In the above embodiments, diamond grains have been arranged as shown in FIGS. 2 and 3. However, the arrangement of diamond grains is not limited to that shown in FIGS. 2 and 3, and arrangements other than those shown in FIGS. 2 and 3 may be adopted so far as the distribution of diamond grains is even. In this case, for example, a certain limitation on the density of diamond grains is provided. For example, on the surface of the support member 1, in areas where diamond grains 2 are present, a variation in density of diamond grains 2 among regions having a given area where several to several tens of diamond grains 2 on average, for example, 20 diamond grains 2, are present, is limited to within ±50%.

In the above embodiments of the present invention, diamond grains 2 have been used as the hard abrasive grains. Alternatively, other materials, for example, cubic boron nitride, boron carbide, silicon carbide, or aluminum oxide may be used as the hard abrasive grains.

In addition to brazing, for example, electrodeposition of nickel may be used for fixation of the diamond grains 2 onto the support member 1.

Fixation of the diamond grains by brazing will be described as a suitable one example of the method for the fixation of the diamond grains. An alloy containing 0.5 to 20% by weight of at least one member selected from titanium, chromium, and zirconium and having a melting point of 650° C. to 1,200° C. is preferably used as a brazing material. In this case, a carbide layer of this metal is formed at the interface between the diamond grains and the brazing alloy. The reason why the content of at least one member selected from titanium, chromium, and zirconium contained in the alloy as the brazing material is preferably 0.5 to 20% by weight is as follows. When the content of the metal is less than 0.5% by weight, the carbide layer of the metal is not formed at the interface between the diamond and the brazing alloy. On the other hand, when the content of the metal is 20% by weight, a carbide layer having satisfactory bonding strength can be formed.

The reason why the melting point of the brazing alloy is preferably 650° C. to 1,200° C. is that, when the brazing temperature is below 650° C., bonding strength cannot be ensured while, when the brazing temperature is above 1,200° C., the diamond is disadvantageously deteriorated.

The thickness of the brazing alloy is preferably 0.2 to 1.5 times that of the diamond grains. When the thickness of the brazing alloy is below the above lower limit value, the bonding strength between the diamond and the brazing alloy is lowered. On the other hand, when the thickness of the brazing alloy is above the upper limit of the above-defined range, the separation between the brazing material and the support member is likely to take place.

The diameter of the diamond grains is preferably in the range of 50 μm to 300 μm. Fine diamond grains having a diameter of less than 50 μm do not provide satisfactory polishing rate, are likely to aggregate, and are likely to come off from the support member. On the other hand, coarse diamond grains having a diameter of more than 300 μm cause large stress concentration at the time of polishing and are likely to come off from the support member.

As described above, according to the first embodiment of the present invention, the use of the CMP conditioner does not have any fear of abrasive grains contained in the slurry being aggregated in CMP conditioner in its portion where hard abrasive grains are densely present. As a result, microscratching of the surface of the semiconductor substrate can be minimized. Further, the difference in properties among CMP conditioners can be eliminated, and, thus, stable CMP conditioner properties can be achieved. Therefore, stable CMP mass production process can be realized.

CMP Conditioner According to Second Aspect of the Invention

Figure 13:
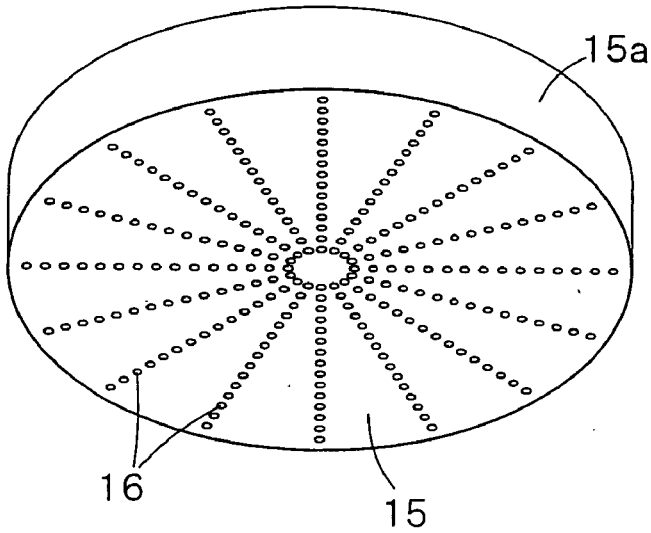
FIG. 13 is a diagram illustrating an arranging plate 15 according to the second aspect of the present invention.
Figure 14:
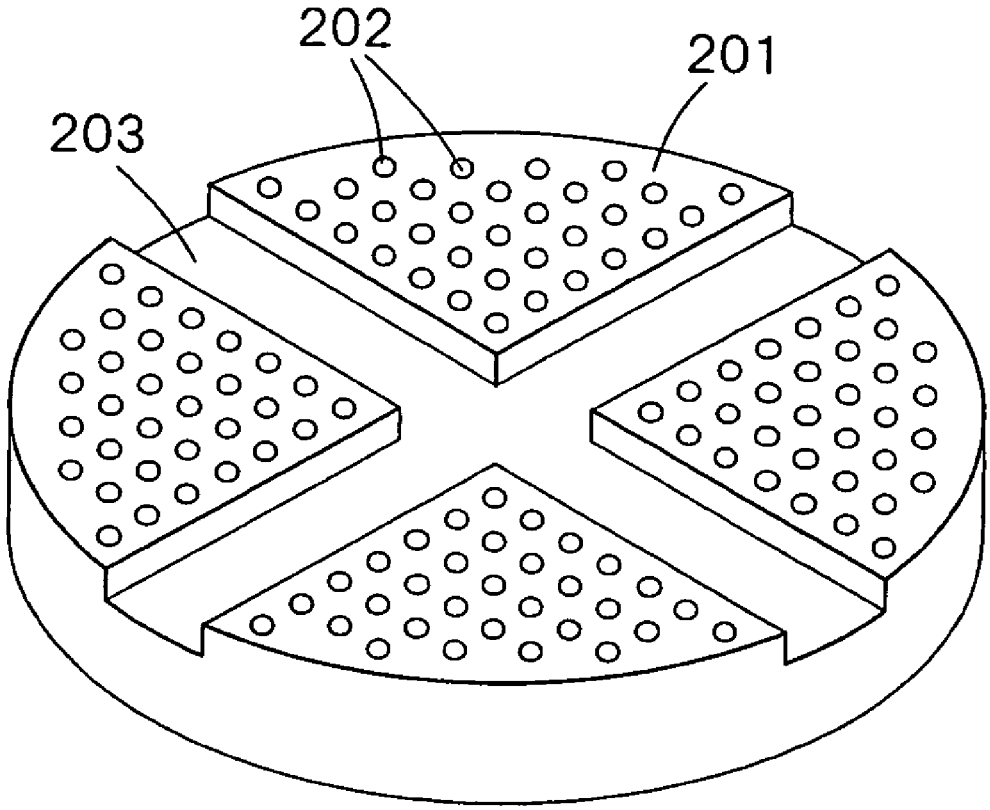
FIG. 14 is a typical diagram showing a CMP conditioner provided with escape grooves 203.

Embodiments of the CMP conditioner for an polishing pad for a semiconductor substrate according to the second aspect of the present invention will be explained with reference to the accompanying drawings. For the method for arranging hard abrasive grains used in the CMP conditioner for an polishing pad for a semiconductor substrate, and the production of the CMP conditioner in this aspect of the present invention may be the same as the first and second methods in the first aspect of the present invention, except that an arranging plate 15 shown in FIG. 13 is used instead of the arranging plate 5 shown in FIG. 5. Therefore, except for this point, the above description in connection with the first aspect of the present invention is applied to the second aspect of the present invention.

Figure 10:
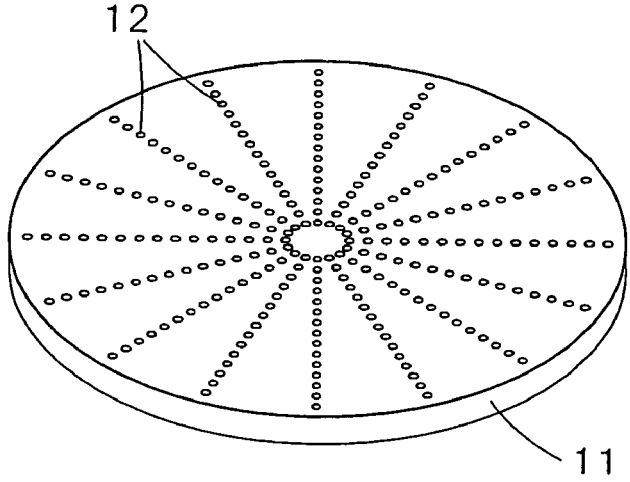
FIG. 10 is an explanatory view of a CMP conditioner according to the second aspect of the present invention.

The CMP conditioner according to the second aspect of the present invention will be described with reference to FIG. 10. As shown in FIG. 10, diamond grains 12 have been fixed as hard abrasive grains onto a surface of a disk-shaped support member 11 formed of a stainless steel or the like.

Figure 11:
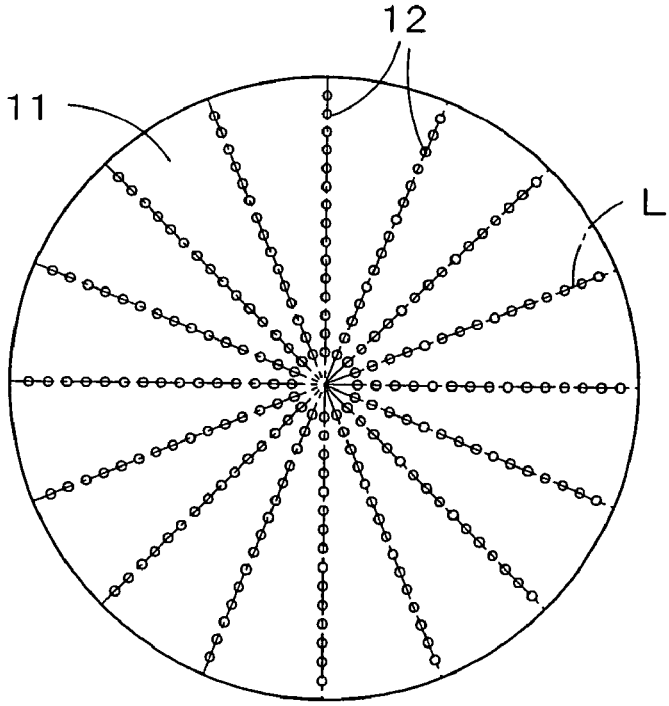
FIG. 11 is a diagram showing one embodiment of the arrangement of diamond grains 12 according to the second aspect of the present invention.
Figure 12:
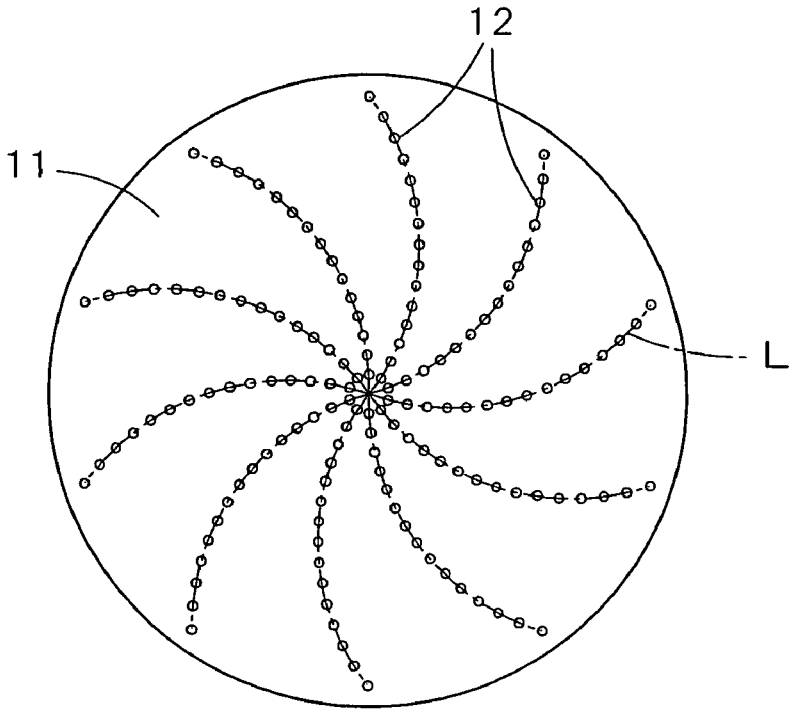
FIG. 12 is a diagram showing one embodiment of the arrangement of diamond grains 12 according to the second aspect of the present invention.

FIGS. 11 and 12 are schematic diagrams showing the arrangement of diamond grains 12 on the surface of the support member 11. In the embodiment shown in FIG. 11, assuming that a plurality of straight lines (alternate long and short dash lines L) extended radially from the center of the disk-shaped support member 11 are provided, diamond grains 12 are provided on these straight lines. In this CMP conditioner, diamond grains 12 are arranged so that the density of diamond grains 12 decreases from the inner side of the support member 11 toward the outer side of the support member 11. Regions, where the diamond grains 12 are absent, are ensured radially on the surface of the support member 11.

On the other hand, in the embodiment shown in FIG. 12, assuming that a plurality of curved lines (alternate long and short dash lines L) extended radially from the center of the disk-shaped support member 11 are provided, diamond grains 12 are provided on these curved lines. In this CMP conditioner, diamond grains 12 are arranged so that the density of diamond grains 12 decreases from the inner side of the support member 11 toward the outer side of the support member 11. Regions, where the diamond grains 12 are absent, are ensured radially on the surface of the support member 11. The term "substantially radially" referred to in the present invention is applied to the embodiment shown in FIG. 11 wherein the diamond grains are arranged radially in a straight line form, as well as in the embodiment shown in FIG. 12 wherein the diamond grains 12 are provided radially in a curved line form.

The size of actual diamond grains 12 is much smaller than that of the support member 11. In FIG. 10 and FIGS. 11 and 12 which will be described later, however, diamond grains 12 are shown in a larger size than the size of actual diamond grains for simplified explanation. Further, the number of straight lines and the number of curved lines are actually provided radially in a denser state. In FIGS. 11 and 12, however, the number of straight lines and the number of curved lines are shown in a simplified form.

In the second aspect of the present invention, the arrangement of the diamond grains 12 and the production of the CMP conditioner may be carried out as in the first and second methods described above in connection with the first aspect of the present invention, except that an arranging plate 15 shown in FIG. 13 is used instead of the arranging plate 5 shown in FIG. 5. As shown in FIG. 13, through-holes 16 for arranging diamond grains 12 are provided in the arranging plate 15. Specifically, in FIG. 13, as with the arrangement shown in FIGS. 11 and 12, through-holes 16 are arranged in the arranging plate 15. The relationship between the diameter X of the through-holes 16 and the size D of the diamond grains 12 satisfies a requirement represented by formula $1.0D<X<2.0D$. Satisfying this relationship can prevent a plurality of diamond grains 12 from simultaneously entering one through-hole 16. A scattering preventive wall 15*a* is provided on the circumference of the arranging plate 15.

As described above, in this embodiment, since the diamond grains 12 are regularly arranged, the difference in properties among CMP conditioners can be eliminated. Therefore, stable CMP conditioner properties can be realized. Further, in this embodiment, the diamond grains 12 are arranged substantially radially from the center of the support member 11 so that the density of the diamond grains decreases from the inner side of the support member 11 toward the outer side of the support member 11. Furthermore, regions, where the diamond grains 12 are absent, are ensured radially. By virtue of the adoption of this construction, at the time of polishing, the slurry can be escaped toward the outer side of the support member 11, contributing to reduced microscratching. Further, since the need to apply special working, to the support member 11, for escaping the slurry can be eliminated, labor and time and cost for working can be reduced.

As described above, according to the second aspect of the present invention, the difference in properties among CMP conditioners is eliminated, and stable CMP conditioner properties can be provided. Therefore, a stable CMP mass-production process can be realized. Further, since the slurry can be escaped at the time of polishing, microscratching can be reduced. Furthermore, since there is no need to apply special working, to the support member, for escaping the slurry, labor and time and cost for working can be reduced.

EXAMPLES

The following examples further illustrate but do not limit the first aspect of the present invention.

Diamond grains having a diameter of 150 to 210 μm were provided. A ferrite stainless steel support member was also provided. In order to fix the diamond grains to the support member, brazing in a single layer was carried out with a brazing metal of Ag—Cu-3Zr (melting point: 800° C.) by holding the assembly in a vacuum of $10^{-5}$ Torr at a brazing temperature of 850° C. for 30 min. Ten CMP conditioners were prepared for each of three types, type A (a conventional type where diamond grains had been manually spread), type B (arrangement in a check form shown in FIG. 2), and type C (arrangement in a honeycomb form shown in FIG. 3).

For each CMP conditioner, an experiment on polishing was carried out for ten semiconductor wafers with a TEOS film. Specifically, for each of types A, B, and C, polishing was carried out for 100 wafers. Dressing was carried out for 2 min once for each one polishing.

Thereafter, for each type, one polished wafer was extracted from every 10 polished wafers in 100 polished wafers. That is, for each type, 10 polished wafers in total were extracted from the 100 polished wafers. For the 10 extracted polished wafers for each type, the number of microscratches was counted. As a result, when the number of microscratches, in the case where the CMP conditioner (dresser) of type A was used, was presumed to be 100, the relative value of the number of microscratches in the case where the CMP conditioner (dresser) of type B was used and the relative value of the number of microscratches in the case where the CMP conditioner (dresser) of type C was used, were 26 and 17, respectively.

These results show that, in the CMP conditioners of types B and C, as compared with the conventional CMP conditioner of type A, the number of microscratches on the surface of the wafer can be significantly reduced. Further, the difference in CMP conditioner properties among CMP conditioners is so small that a stable CMP mass-production process can be realized.

The invention claimed is

1. A method for arranging hard abrasive grains for use in a CMP conditioner, comprising the steps of:

holding a plurality of hard abrasive grains, in a regularly arranged state, on a holding member comprising a pressure-sensitive adhesive sheet; and transferring the hard abrasive grains held on the pressure-sensitive adhesive sheet onto the surface of a support member for constituting the CMP conditioner, wherein said pressure-sensitive adhesive sheet has a first adhesive for holding the hard abrasive grains and said support member has on its surface a second adhesive for holding the hard abrasive grains which is different from said first adhesive in solubility, dissolving only said first adhesive on said pressure-sensitive adhesive sheet thereby removing only said pressure-sensitive adhesive sheet from said hard abrasive grains held by said second adhesive on said support member.

2. A method of arranging hard abrasive grains according to claim 1, further comprising the step of:

fixing the hard abrasive grains on the surface of the support member.

3. A method for arranging hard abrasive grains according to claim 1, wherein the regularly arranged state is:

such a state that the hard abrasive grains are arranged regularly so as for the density of said hard abrasive grains to decrease from the inner side toward the outer side of the pressure-sensitive adhesive sheet.

4. A method for arranging hard abrasive grains according to claim 1, wherein the regularly arranged state is:

such a state on the pressure-sensitive adhesive sheet that regions free from said plurality of hard abrasive grains are provided substantially radially

5. A method of arranging hard abrasive grains according to claim 3 or 4, further comprising the step of:

fixing the hard abrasive grains on the surface of the support member.

* * * * *